US007275774B2

(12) United States Patent
Oberheide

(10) Patent No.: US 7,275,774 B2
(45) Date of Patent: Oct. 2, 2007

(54) SIDE DOOR STRIKER AND METHOD OF OPERATION

(75) Inventor: G. Clarke Oberheide, Troy, MI (US)

(73) Assignee: Ntier Automotive Closures Inc., Newmarket, Ontario (CA)

( * ) Notice: Subject to any disclaimer, the term of this patent is extended or adjusted under 35 U.S.C. 154(b) by 212 days.

(21) Appl. No.: 10/843,047

(22) Filed: May 11, 2004

(65) Prior Publication Data

US 2004/0227363 A1 Nov. 18, 2004

(51) Int. Cl.
*E05B 15/02* (2006.01)
*E05C 1/06* (2006.01)

(52) U.S. Cl. ..... 292/341.16; 292/144; 292/340; 292/341.15; 292/DIG. 24

(58) Field of Classification Search ..... 292/341.16, 292/144, 340, 341.15, DIG. 24
See application file for complete search history.

(56) References Cited

U.S. PATENT DOCUMENTS

| | | | | | |
|---|---|---|---|---|---|
| 2,903,288 | A | | 9/1959 | Joachim et al. | |
| 2,916,319 | A | | 12/1959 | DuBois | |
| 3,403,934 | A | * | 10/1968 | Butts | 292/341.16 |
| 4,707,007 | A | | 11/1987 | Inoh | |
| 4,746,153 | A | | 5/1988 | Compeau et al. | |
| 4,796,932 | A | * | 1/1989 | Tame | 292/112 |
| 4,842,313 | A | | 6/1989 | Boyko et al. | |
| 4,982,984 | A | | 1/1991 | Yokota et al. | |
| 4,998,049 | A | | 3/1991 | Chapman | |
| 5,066,056 | A | | 11/1991 | Schap | |
| RE33,758 | E | | 12/1991 | Compeau et al. | |
| 5,172,947 | A | * | 12/1992 | Schap | 292/341.16 |
| 5,273,325 | A | * | 12/1993 | Zimmermann | 292/216 |
| 5,746,459 | A | * | 5/1998 | Giroux et al. | 292/341.16 |
| 5,765,886 | A | * | 6/1998 | Buchanan, Jr. | 292/341.16 |
| 5,938,254 | A | | 8/1999 | Weyerstall | |
| 6,068,309 | A | * | 5/2000 | Jung et al. | 292/341.17 |
| 6,175,528 | B1 | | 1/2001 | Kye | |
| 6,312,045 | B2 | | 11/2001 | Kitagawa | |
| 6,581,990 | B1 | | 6/2003 | Menke et al. | |
| 6,666,487 | B2 | * | 12/2003 | Oxley et al. | 292/341.16 |
| 6,715,808 | B2 | * | 4/2004 | Oxley et al. | 292/341.16 |
| 2003/0075934 | A1 | | 4/2003 | Oxley et al. | |
| 2003/0094820 | A1 | * | 5/2003 | Erices | 292/341.16 |
| 2003/0164617 | A1 | * | 9/2003 | Kuhnke | 292/341.16 |

FOREIGN PATENT DOCUMENTS

| | | | |
|---|---|---|---|
| DE | 3721963 | * | 10/1988 |
| DE | 19616655 | * | 10/1997 |

* cited by examiner

*Primary Examiner*—Carlos Lugo
(74) *Attorney, Agent, or Firm*—Clark Hill PLC

(57) ABSTRACT

A striker assembly reduces a force of a latch required to latch and unlatch a side door over a door opening of a motor vehicle. The door opening includes a striker opening which is disposed adjacent the door opening. The striker assembly includes a frame fixedly secured to the motor vehicle over the striker opening. The base includes a base opening. A striker assembly also includes a striker slidably secured to the frame allowing the striker to move outboard during the unlatching of the side door and inboard during the latching of the side door.

6 Claims, 7 Drawing Sheets

SIDE DOOR STRIKER AND METHOD OF OPERATION

FIELD OF THE INVENTION

The invention relates to a striker assembly. More specifically, the invention relates to a striker assembly with a movable striker to ease the opening and closing of a side door.

DESCRIPTION OF THE RELATED ART

The automotive industry is continually providing product that has an increased acceptability and operability to a wider range of operators. One of the developments in the automotive industry is a remote keyless entry or passive keyless entry system. This allows the operator of a vehicle to unlock the vehicle to obtain access thereto without inserting a key into a key lock. A more recent development is the use of a key fob with a transponder that automatically conveys authorization to unlock the vehicle. More specifically, as the holder of the transponder-equipped key fob approaches the vehicle, the vehicle will sense the holder approaching and unlock the vehicle for a period of time.

These developments enable the operator(s) of a vehicle to easily negotiate a locking mechanism allowing the operator to access the vehicle. These systems do not, however, address the need to make the doors easier to open.

For an operator to open a side door, a force must be applied to the handle of the side door that is sufficient to overcome closure forces. These closure forces are created by two separate sources: (1) a force required to unlatch the side door from the motor vehicle and (2) a force required to overcome the seal between the side door and the motor vehicle. By reducing or eliminating one of the closure forces, at or around the time it is anticipated that the side door will need to be opened, the opening force that needs to be applied to the handle can be reduced.

Just as opening forces are needed to open the side door, closing forces are required to close the side door. Again, by reducing the closure forces required by the side door at the time the side door is being closed, the closing forces may be reduced. In addition to reducing the requirements of the opening and closing forces, the operator will be able to open and close the door with greater ease. The operator will thus perceive that the side door operates smoothly with a high degree of craftsmanship.

SUMMARY OF THE INVENTION

A striker assembly reduces a force or effort required to latch and unlatch a side door of a motor vehicle. The striker assembly includes a mounting plate fixedly secured to the motor vehicle. The base includes a base opening. A striker assembly also includes a striker slidably secured to the frame allowing the striker to move outboard during the unlatching of the side door and inboard during the latching of the side door.

BRIEF DESCRIPTION OF THE DRAWINGS

Advantages of the invention will be readily appreciated as the same becomes better understood by reference to the following detailed description of a preferred embodiment when considered in connection with the accompanying drawings, wherein.

DETAILED DESCRIPTION OF THE PREFERRED EMBODIMENTS

Figure 1:
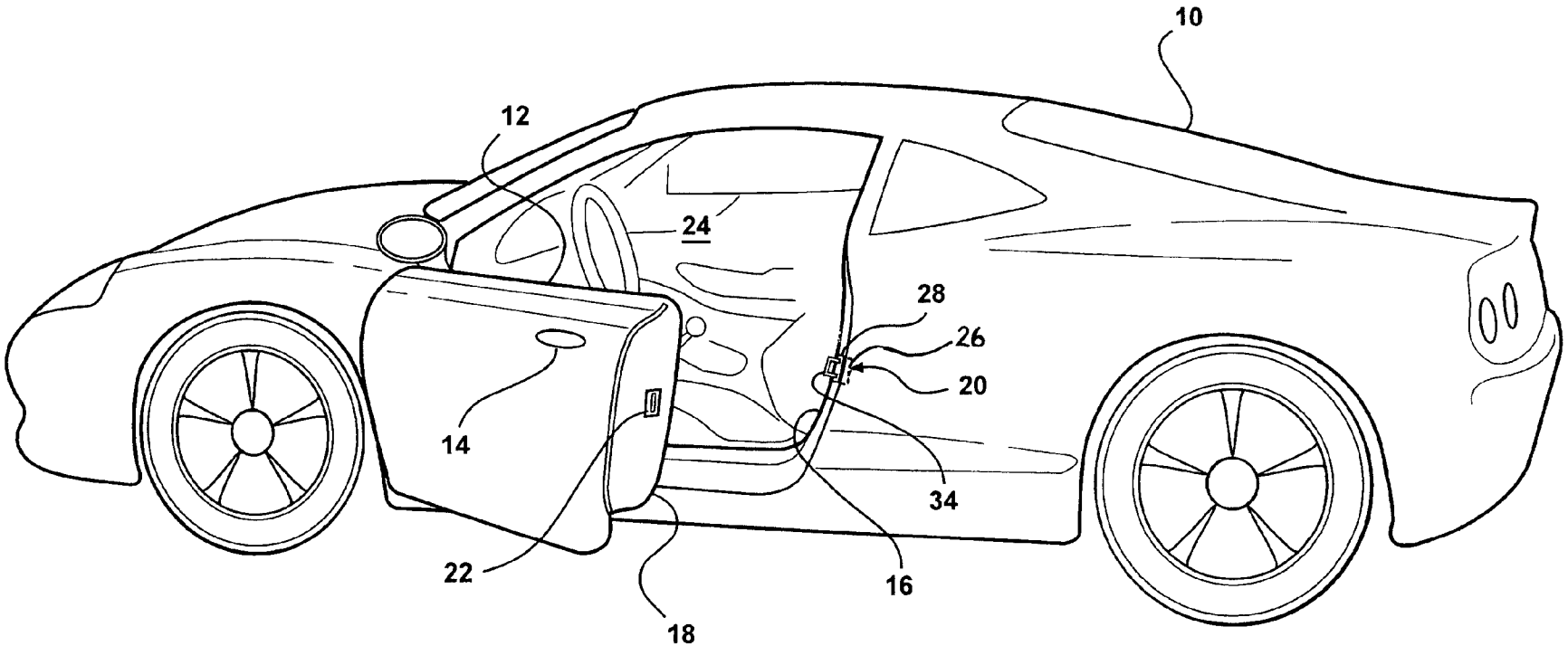
FIG. 1 is a perspective view, partially cut away, of a motor vehicle incorporating a preferred embodiment of the invention.

Referring to FIG. 1, a vehicle 10 is shown partially cut away. The vehicle 10 has a side door 12 operatively connected to a handle 14. The handle 14 is manipulated to unlatch the side door 12 when an operator chooses to open the side door 12. The vehicle 10 forms a door jamb 16 against which an end 18 of the side door 12 abuts when the side door 12 is in the closed position. The door jamb 16 is commonly referred to as the B-pillar of the vehicle 10.

A striker assembly, generally indicated at 20, extends out from the door jamb 16 and is positioned to engage a latch 22 that is mounted in the end 18 of the side door 12. The handle 14 has a mechanical link (not shown) that links the handle 14 to the latch 22. When the handle 14 is activated by pulling it, the latch 22 unlatches the side door 12 by disengaging the striking assembly 20 allowing the side door 12 to open.

Referring to FIGS. 2 through 13, the striker assembly 20 is generally shown. The striker assembly 20 is designed to reduce a force required of the latch 22 to latch and unlatch the side door 12 that closes a door opening 24 of the vehicle 10. The striker assembly 20 covers a striker opening, 26 that extends through the door jamb 16.

The striker assembly 20 includes a mounting plate 28 that is fixedly secured to the vehicle 10 over the striker opening 26. The mounting plate 28 has a plurality of spaced apart elongated lateral slots 30. The mounting plate 28 also includes a plurality of fastening apertures 32 spaced about the periphery thereof. It should be appreciated by those skilled in the art that while the mounting plate 28 is shown to be rectangular in shape, any shape required by the design of the striker assembly 20 and the door jamb 16 may be utilized to properly secure the striker assembly 20 to the vehicle.

The striker assembly 20 also includes a striker 34 which is slidably secured to the mounting plate 28, as described in greater detail below, in order to allow the striker 34 to reciprocate outboard during the unlatching of the side door 12 and inboard during the latching of the side door 12. The striker 34 is also shown to be rectangular in shape having an aperture 36 extending therethrough. It should be appreciated that the striker 34 may be in a shape or configuration other than a rectangle having an aperture 36 so long as the striker 34 provides an edge or a surface against which the latch 22 may latch the side door 12 to the vehicle 10.

Figure 2:
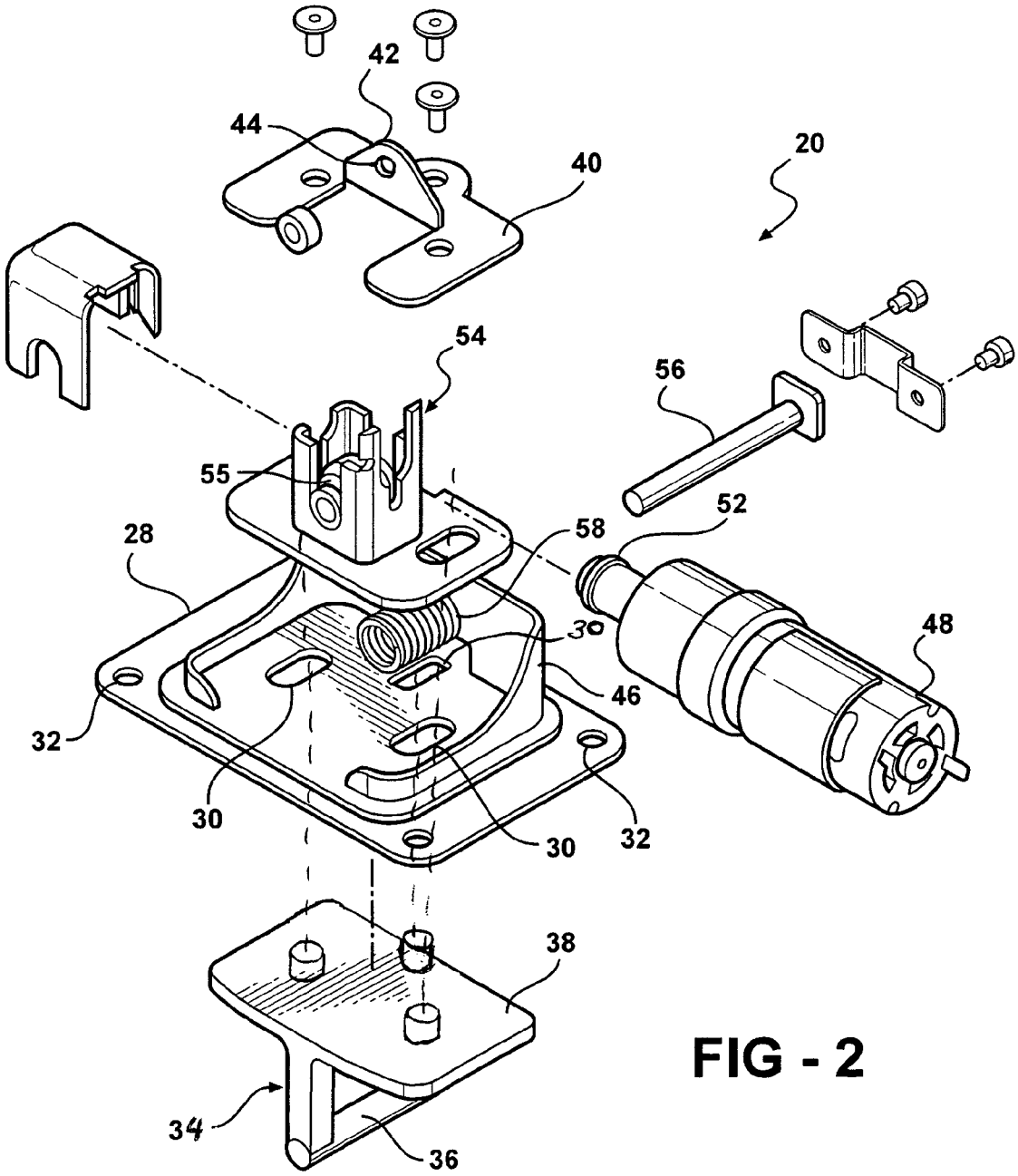
FIG. 2 is an exploded view of the preferred embodiment.
Figure 3:
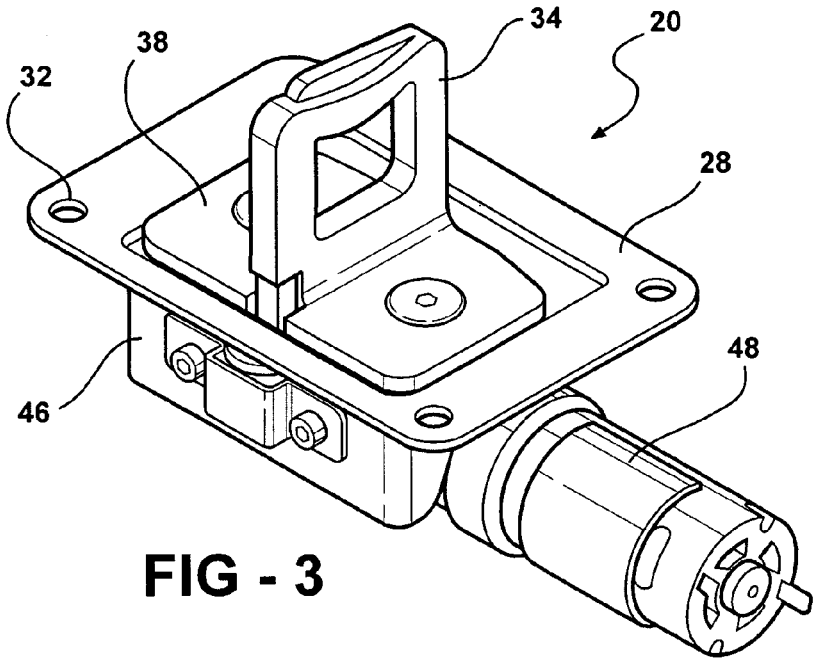
FIG. 3 is a top perspective view of the preferred embodiment.
Figure 4:
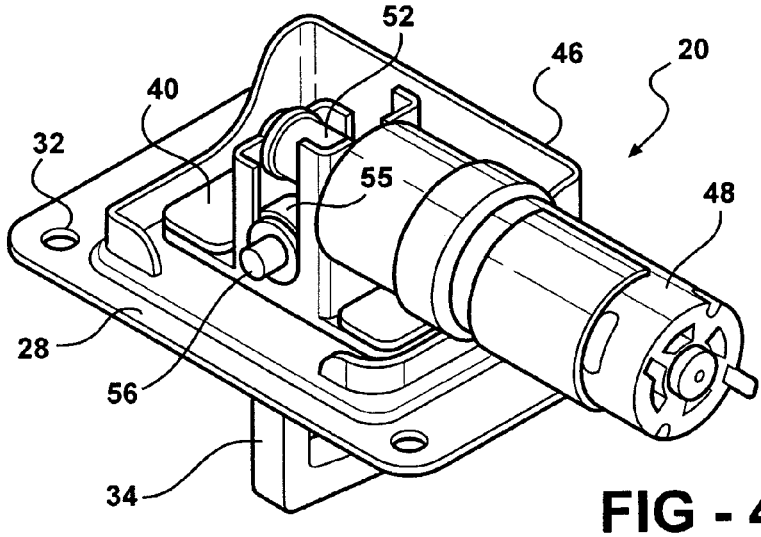
FIG. 4 is a bottom perspective view of the preferred embodiment.
Figure 5:
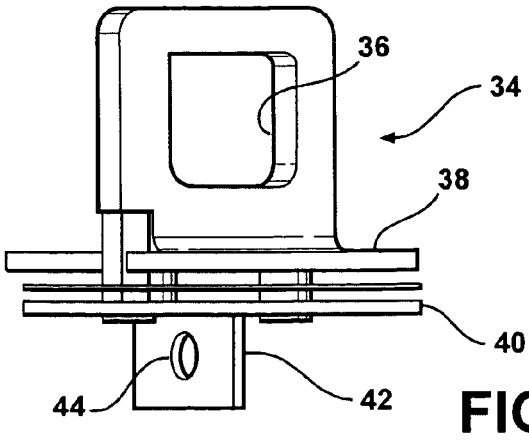
FIG. 5 is a perspective view of a striker and base place.
Figure 6:
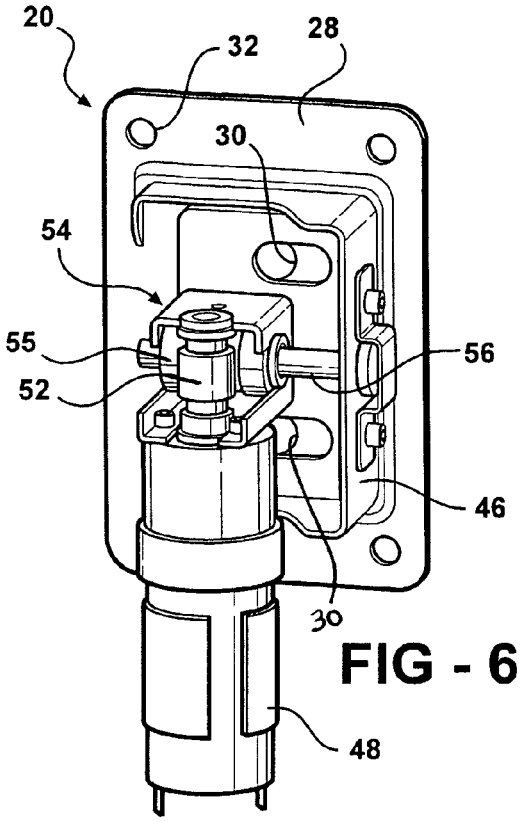
FIG. 6 is a rear view of the preferred embodiment without the striker, shown in the closed position.
Figure 7:
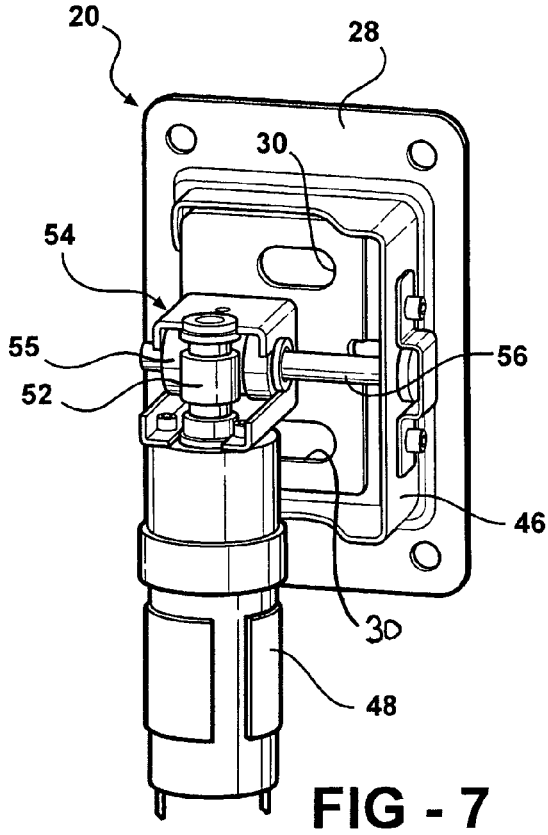
FIG. 7 is rear view of the preferred embodiment, without the striker, shown in the open position.
Figure 8:
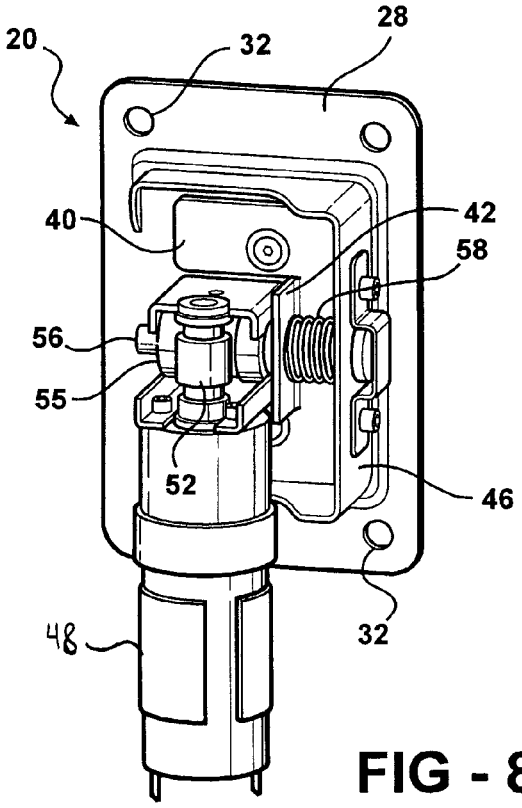
FIG. 8 is a rear view of the preferred embodiment in the closed position.
Figure 9:
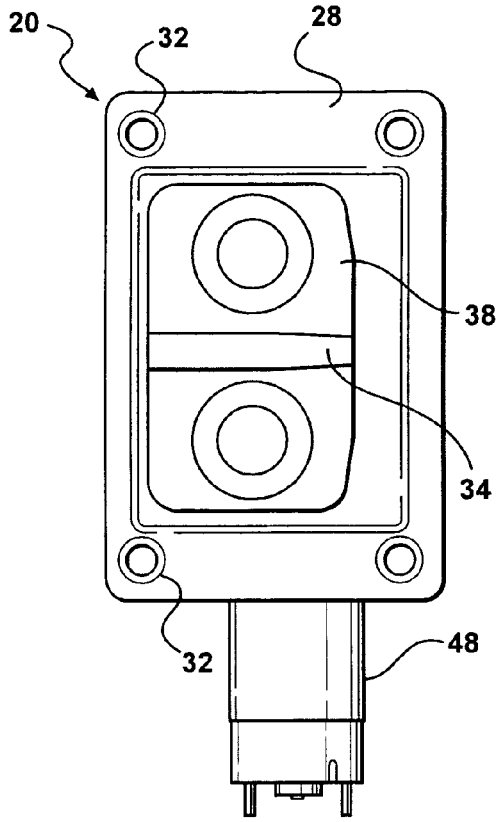
FIG. 9 is a front view of the preferred embodiment shown in the closed position.
Figure 10:
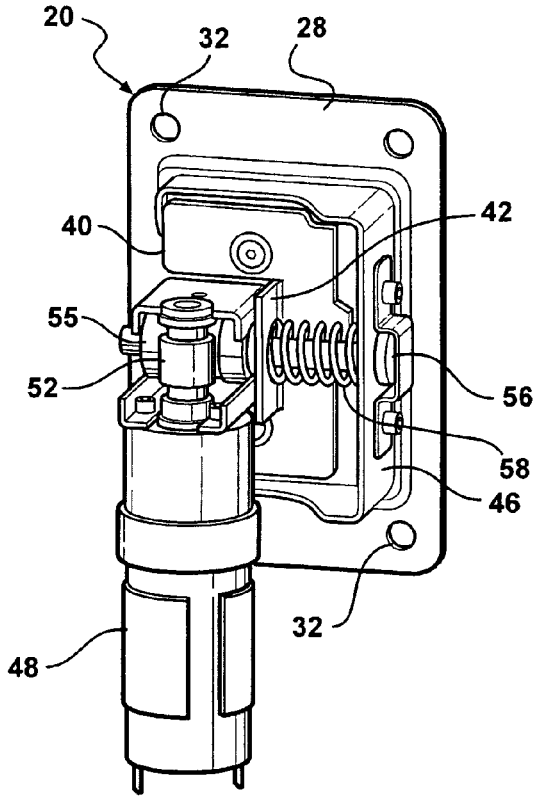
FIG. 10 is a rear view of the preferred embodiment shown in the open position.
Figure 11:
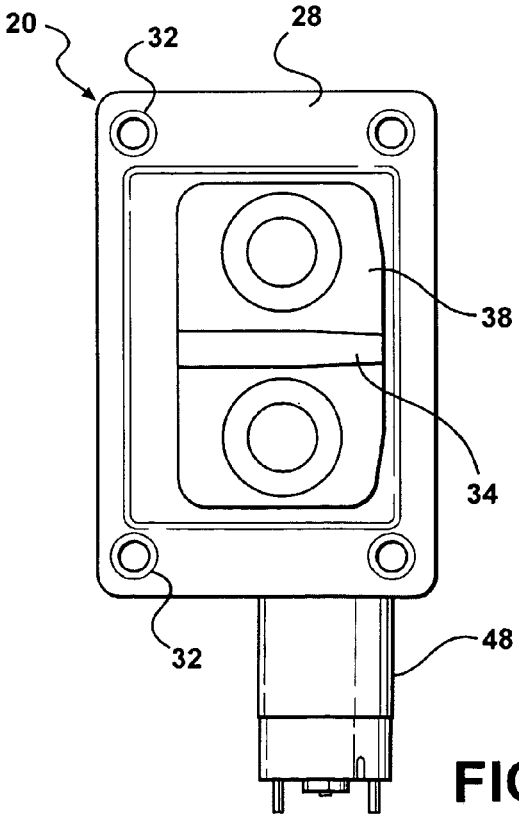
FIG. 11 is a front view of the preferred embodiment shown in the open position.

Referring specifically to FIGS. 2 and 5, the striker 34 includes a base plate 38 and a drive plate 40. The base plate 38 is fixedly secured to the striker 34 and extends perpendicular thereto. Likewise, the drive plate 40 is fixedly secured to the striker 34 and is perpendicular thereto. The base plate 38 and the drive plate 40 are generally parallel to each other. In addition, the base plate 38 is spaced apart from the drive plate 40 approximately the thickness of the mounting plate 28. The base plate 38 and drive plate 40 guide the striker 34 as it slides along the mounting plate 28. Extending perpendicular from the base plate 38 is a drive flange 42. The drive flange 42 includes a lead aperture 44. The drive flange 42 extends perpendicularly to both the base 38 and drive plates 40.

Extending out and away from the mounting plate 28 is a housing 46. The housing 46 provides additional support to elements that are secured to the mounting plate 28.

One of the elements secured to the mounting plate 28 is a motor 48. The motor 48 is electrically connected to a control circuit 50, generally shown in FIG. 14, to receive electrical signals therefrom. The motor 48 receives electrical power and, based on the instructions from the control circuit 50, transforms the electrical power into mechanical power to indirectly move the striker 34 in a sliding movement inboard and outboard along the door jamb 16 to facilitate the opening and closing of the side door 12 with respect to the vehicle 10. The motor 48 transmits power through an output shaft 52 to a drive mechanism 54.

The drive mechanism 54 includes a lead screw 56 threadingly engaging a follower 55. The lead screw 56 is rotatably secured to the housing 46. The follower 55 travels along the lead screw 56 as it is rotated by the motor 48. The lead screw 56 extends through aperture 44 of drive flange 42. Rotation of the lead screw 56 in a first sense urges the follower 55 to engage the drive flange 42 toward the inboard position.

A compression spring 58 is mounted between the housing 46 and the drive flange 42 of the striker 34 to urge the striker 34 toward the outboard position. Moving the door 12 away from a primary closed position to a secondary closed position allows the door 12 to be opened with less effort, as known in the art per se. The compression spring 58 absorbs the energy during closing of the door 12, this protects the motor 48 from shock loads of the door 12 slamming.

Figure 14:
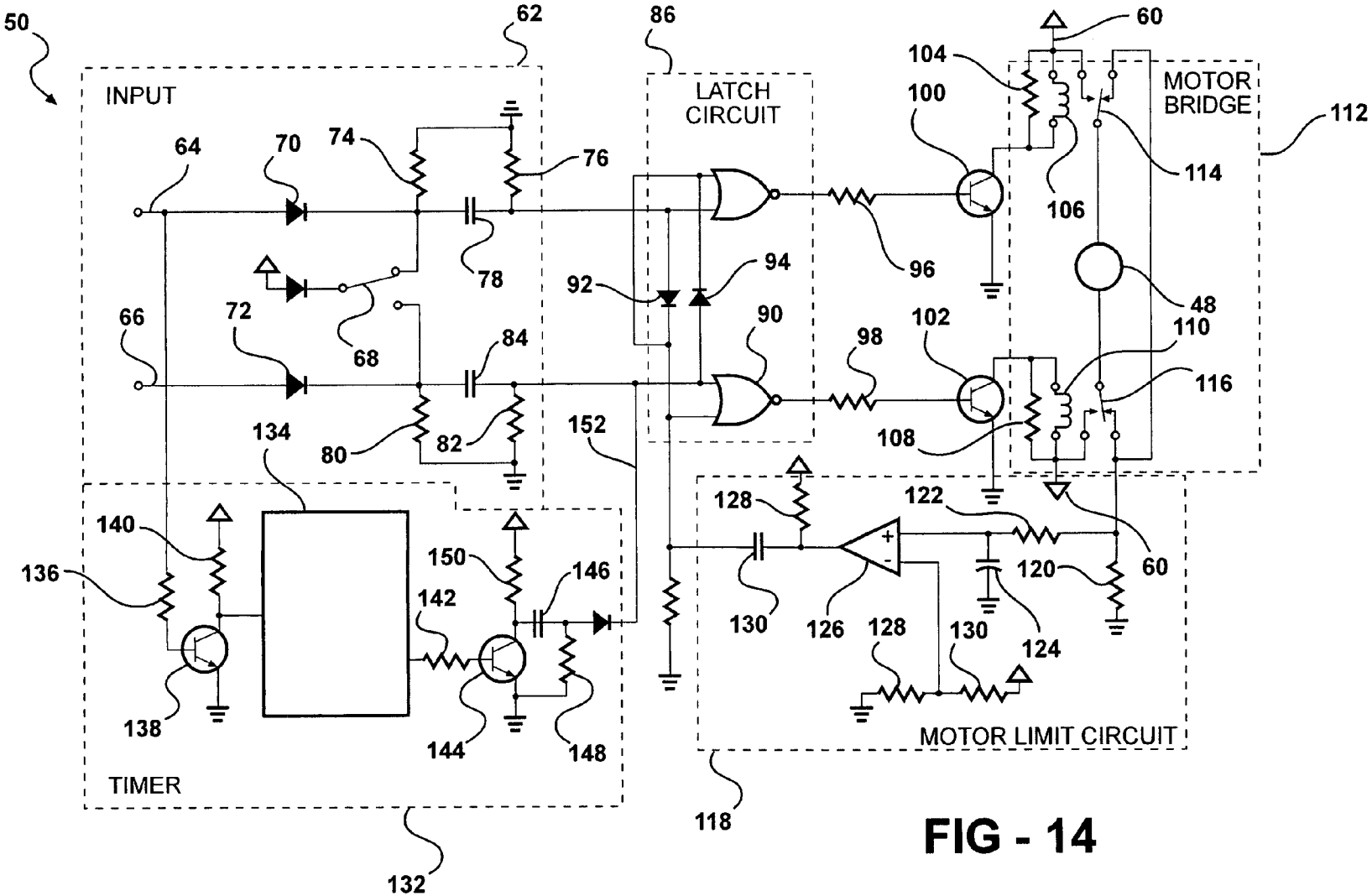
FIG. 14 is a schematic drawing of one implementation of a controlled circuit for the preferred embodiment.

Referring to FIG. 14, the control circuit is generally indicated at 50. The control circuit 50 is powered by a standard power supply at 60, preferably 12 Volts. The control circuit 50 includes an input circuit 62 that is capable of receiving two types of inputs. The first type of input is electronic and it is received through an "unlock" terminal 64 and a "lock" terminal 66. If the control circuit 50 receives an unlock signal either from a keypad or key fob, the signal will be received at the unlock terminal 64. If, however, the electronic signal is a lock signal, that will be received at the lock terminal 66. A second type of signal that is received through the input circuit 62 is a manual signal received by a latch switch 68. The latch switch 68 is physically tied to the latch 22 of the side door 12 and movement thereof by an operator will switch the latch switch 68 between an unlatched state (as shown in FIG. 14) and a latched state. A portion of the power supply 60 is fed through the latch switch 68 allowing power to be passed through the input circuit 62 should the latch 68 be the device used to open the side door 12. Diodes 70, 72 prevent current from passing back through the input circuit 62 toward the unlock terminal 64 and the lock terminal 66. Resistors 74, 76 and capacitor 78 filter the signal as it passes toward the output of the input circuit 62. Likewise resistors 80, 82 and capacitor 84 filter the signal passing out of the input circuit 62 should the signal being emitted therefrom be a lock signal.

The outputs of the input circuit 62 are connected to a latch circuit 86. The latch circuit 86 consists primarily of an SR latch set that includes two SR latches 88, 90. The SR latch 88 is a reset latch and when its output is low, the striker 34 is moved outboard. Likewise, the SR latch 90 is a set latch and when its output is high, the striker 34 moves inboard. Diodes 92, 94 cross-couple the reset latch 88 and the set latch 90 together. The outputs of the latch circuit 86 pass through resistors 96, 98 and are received by amplifying transistors 100, 102, respectively. These transistors 100, 102 are connected to a power supply 60 through a resistor 104 and inductor 106, and resistor 108 and inductor 110, respectively. These components 104, 106, 108 and 110, which provide a current smoothing function, are part of a motor bridge 112 that includes two relays 114, 116 that operate the motor 48. The, relays 114, 116 are bi-directional allowing the motor bridge 112 to operate the motor 48 in two directions. These two directions of operation allow the motor 48 to move the striker 34 inboard and outboard.

The control circuit 50 also includes a motor limit circuit 118 that resets the latch circuit 86 when the motor 48 is driven to one end or another. The motor limit circuit 118 includes a sensing resistor 120 that determines when the current of the motor passing therethrough drops to zero identifying the position at which the motor 48 is stalling due to its travel limits. After passing through an RC filter comprised of a resistor 122 and capacitor 124, the potential is input into a non-inverting input of a comparator 126. The inverting input of the comparator 126 is from a voltage divider that includes two resistors 128, 130. The output of the comparator 126 passes through another RC circuit that includes a resistor 128 and a capacitor 130. The output of the motor limit circuit 118 is directed to the input of the latch circuit 86 to reset the latch circuit 86 such that power is removed from the motor bridge 112.

The control circuit 50 also includes a timer circuit 132. The timer circuit 132 resets the latch circuit 86 if the time between receipt of an unlock signal through terminal 64 and the time in which the side door 12 is manually opened exceeds a predetermined time period. As designed, the timer circuit 132 will reset the latch circuit 86 returning the striker 34 back to its inboard position should the time period from which an unlock signal is received and the handle 14 moves exceeds 30 seconds. This will prevent the striker 34 from maintaining a position that is vulnerable should an operator fail to open the side door 12 after that operator has unlocked the side door 12. The timer circuit includes a clock chip 134 that receives its input from the unlocked terminal 64 through a resistor 136 and a transistor 138. Resistor 140 and the resistor 136 act as a voltage divider for the clock chip 134. The output of the clock chip 134 passes through a resistor 142 and is received by a transistor 144 that is filtered using a capacitor 146 and a resistor 148. A resistor 150 combines with a resistor 148 to create a second voltage divider for a portion of the power supply 60 that is received by the resistor 150 once the transistor 144 opens. The output 152 of the timer circuit 132 is electrically connected to the set latch 90 of the latch circuit 86. Thus, when the timer circuit 132 becomes active, the set latch 90 creates a signal forcing the motor bridge 112 to operate the motor to move the striker 34 to its inboard position.

Upon the closing of the side door 12, less force is required to have the latch 22 engage the striker 34. This is due to the fact that the striker 34 is in its outboard or secondary closed position, where the door seals need not be compressed. When the latch 22 does engage the striker 34, the striker assembly 20 moves the striker 34 inboard effecting the side door 12 to move to its fully closed position and compressing the door seals.

Figure 12:
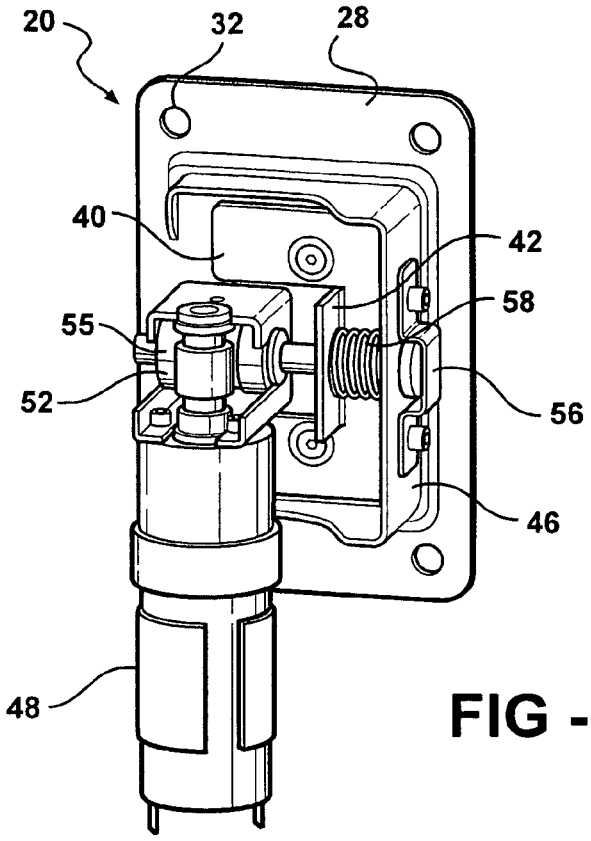
FIG. 12 is a rear view of the preferred embodiment in an open position with the striker positioned as if the side door has been slammed shut.
Figure 13:
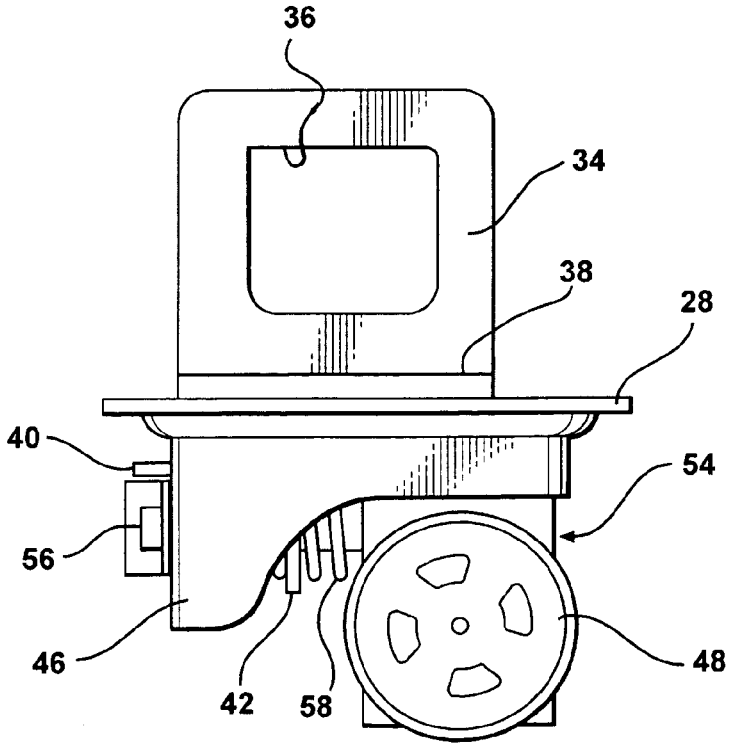
FIG. 13 is an end view 6*f* the preferred embodiment.

As is shown in FIG. 12, the drive mechanism 54 is in it open configuration but the striker 34 is in its closed position. This is because the side door 12 has been slammed shut. An advantage of the invention as disclosed herein includes the fact that the drive mechanism 54 is not coupled to the motor 48. This allows the compression spring 58 of the striker assembly 20 to absorb energy from abrupt closures of the side door 12.

The invention has been described in an illustrative manner. It is to be understood that the terminology, which has been used, is intended to be in the nature of words of description rather than of limitation. Many modifications and variations of the invention are possible in light of the above teachings.

What is claimed is:

1. A striker assembly for latching and unlatching a side door of a motor vehicle, said striker assembly comprising:

a mounting plate adapted to be fixedly secured to the motor vehicle;

a striker slidably coupled to said mounting plate and moveable relative to said mounting plate between an inboard position for latching of the side door and an outboard position for unlatching of the side door;

a drive mechanism slidably coupled between said mounting plate and said striker for selectively engaging said striker and moving said striker from said outboard position to said inboard position;

a motor supported by said mounting plate and operatively coupled to said drive mechanism, whereby energizing said motor in a first sense drives said drive mechanism against said striker to move said striker to said inboard position and energizing said motor in a second opposite sense moves said drive mechanism away from said striker;

a spring compressed between said striker and said mounting plate for biasing said striker towards said outboard position whereby said spring allows independent relative movement between said striker and said drive mechanism to absorb impact energy from the side door contacting said striker in said outboard position;

said drive mechanism including a carriage slidably coupled to said mounting plate and said striker for lateral movement along said mounting plate independent of said striker between said inboard and outboard positions a lead screw rotatably coupled between said carriage and said mounting plate for guiding said carriage between said inboard and outboard positions, and a follower rotatably coupled to said carriage and threaded to said lead screw, said follower operatively engaged with said motor for transferring rotational force generated by said motor into axial movement alone said lead screw to drive said carriage between said inboard and outboard positions.

2. A striker assembly as set forth in claim 1 wherein said striker includes a base plate and a drive plate interconnected on opposing sides of said mounting plate.

3. A striker assembly as set forth in claim 2 wherein said drive plate includes a drive flange positioned between said mounting plate and said carriage of said drive mechanism for selective engagement with said drive mechanism during movement from said inboard position to said outboard position.

4. A striker assembly as set forth in claim 3 wherein said drive flange includes an aperture for receiving said lead screw therethrough and guiding said striker along said lead screw between said inboard and outboard positions.

5. A striker assembly as set forth in claim 4 wherein mounting plate includes a housing for enclosing said carriage of said drive mechanism and said drive plate of said striker.

6. A striker assembly as set forth in claim 5 wherein said spring includes a compression spring seated between said drive flange and said housing for biasing said striker toward said outboard position and against said carriage of said drive mechanism.

* * * * *

UNITED STATES PATENT AND TRADEMARK OFFICE

CERTIFICATE OF CORRECTION

PATENT NO. : 7,275,774 B2
APPLICATION NO. : 10/843047
DATED : October 2, 2007
INVENTOR(S) : Oberheide It is certified that error appears in the above-identified patent and that said Letters Patent is hereby corrected as shown below:

On the Title page, (73) the Assignee should be listed as:

Intier Automotive Closures, Inc.

Signed and Sealed this

Eighth Day of January, 2008

JON W. DUDAS
*Director of the United States Patent and Trademark Office*